US005572821A

United States Patent [19]

Coleman

[11] Patent Number: 5,572,821

[45] Date of Patent: Nov. 12, 1996

[54] C-CHANNEL FRAME CONSTRUCTION FOR A SIGN

[76] Inventor: Kelly R. Coleman, 516 Belle Isle Ave., Belleair Beach, Fla. 34635

[21] Appl. No.: 435,911

[22] Filed: May 5, 1995

Related U.S. Application Data

[63] Continuation of Ser. No. 57,967, May 7, 1993, abandoned.

[51] Int. Cl.[6] ..... G09F 17/00

[52] U.S. Cl. ..... 40/603; 160/328; 160/378; 52/222

[58] Field of Search ..... 40/574, 603, 604; 38/102.1, 102.2, 102.91; 160/328, 378; 52/63, 222, 720.1; 135/119; 24/460, 461, 462, 581

[56] References Cited

U.S. PATENT DOCUMENTS 4,265,039 5/1981 Brooks .

4,937,961 7/1990 Gandy et al. ..... 160/378 X 5,255,459 10/1993 Verret ..... 40/603

5,301,447 4/1994 Lotter et al. ..... 40/603

*Primary Examiner*—Brian K. Green

*Attorney, Agent, or Firm*—Edwin E. Greigg; Ronald E. Greigg

[57] ABSTRACT

A display device in the form of a sign having spaced frame construction whereas one or more C-Channel shaped periphery edge frames are secured in a back-to-back relation such that the display faces attached to the outer portion of each frame is viewable from the exterior position relative to the device. The peripheral edge frame if single sided or the peripheral edge frames if the device is multiple sided are secured thereto by a plurality of pairs of cross members attached in an interconnecting relation to each frame such that the space between the bars is determined by the configuration of the interior support member(s) or it is determined by the architectural style and strength required by the designer. A cover in the form of a sheet is positioned around the outside periphery of the device to at least partially enclose the interior thereof.

20 Claims, 3 Drawing Sheets

C-CHANNEL FRAME CONSTRUCTION FOR A SIGN

This is a continuation of application Ser. No. 08/057,967 filed on May 7, 1993 now abandoned.

BACKGROUND OF THE INVENTION

1. Field of the Invention

The invention relates to a sign including a C-Channel frame construction wherein one or more peripheral edge frames are assembled with back braces arranged and spaced in a substantially back to back relation to one another. The space between the frames is limited only to the imagination of the designer or are designed to accommodate a specific size of upright(s) or a single pole requirement.

2. Description Of The Prior Art

This invention is an improvement over U.S. Pat. No. 3,893,251. In the advertising industry the use of display devices in the form of signs which are permanently mounted at a given location is of course extremely well known. The particular configuration or construction of the sign utilized in any given advertising application depends upon such things as type of business goods or services being advertised, location at which the sign or display device is to be located and the particular segment of the public to which the advertisement is directed. Because of these many diverse applications, there is of course a demand for various types of signs. This variety of demand severely restricts the mass production or the use of mass production techniques in producing a generally standard-type sign. Accordingly such a mass produced sign has been relatively unknown in the advertising industry. It is readily understood why large scale or mass production of a substantially standard display device is highly desirable from an economic standpoint. In addition, maintenance of a standard-type sign would also involve the expenditure of less money since repair or servicing of such a sign could be done on a replacement part type basis.

Other disadvantages inherent in the production and use of a custom made sign includes the cost involved in installing these signs which often times equals or exceeds the actual production cost. Since up to the present time no one single sign structure has had the versatility to satisfy the wide variety of advertising needs, the installation of the varying sign structures would also have to be done on a custom installation type basis. Since a custom built sign had to be produced which adapted to a particular location or business to be advertised, those involved in installing these prior art structures would often times be dealing with completely different structures of which they had no general knowledge or experience. Because of the above factors, the time and expense involved in the installation of conventional signs is relatively great.

Because of these and other commonly known problems prevalent in the advertising and sign making industry, there has been a long felt need for a display device which is versatile enough to be adapted to a number of various advertising situations. At the same time, such a display device must comprise a relatively simple, low-cost construction capable of being easily maintained and transported to any given location. Ideally, such a sign structure would be of a somewhat standard type construction which was capable of being built through the application of mass production techniques. In addition, the versatility of such a structure would include its being installed on diverse types of supporting devices regardless of their size or shape.

The state of the art for Spaced Frame Construction was patented by the inventor, Coleman Patent No. 3,893,251 Jul. 8, 1975. Since that time, there has been continued pressure on sign fabricators for more diverse and cost effective means of building signs and moreover a system with ease of fabrication and flexibility to be sized to meet the requirements of various local code restrictions which bring on many size variations never before known to the sign industry.

C-Channel construction is similar to Spaced Frame Construction in that both systems use an extruded or fabricated peripheral edge frame, however, the Space Frame Construction was dependent on tabs which were attached to each frame with bolted cross members to these tabs. C-Channel construction has eliminate the tabs in favor of a C-Channel peripheral edge frame which accepts a cross member within or over the outside of the peripheral edge frame. This construction increases strength and reduces labor by elimination of the tabs and the increased strength from the interconnecting cross members and peripheral edge frames.

A second distinct difference between Space Frame Construction and C-Channel construction is that the Spaced Frame Construction was dependent on an interior pole for structural strength whereas C-Channel construction utilized interior vertical or horizontal supports which are attached at the top and bottom to the cross members thereby eliminating the need for a center pole. A manufacturing advantage is gained, also a reduction of weight for freight savings in general.

The third valuable gain is the expedience of installation in the field. With C-Channel construction, the support members are arranged so that the sign structure slides over an upright of any configuration dictated either by a designer or engineers requirements. The structure may be designed to fit on existing field condition of one or more uprights and horizontal, vertical or diagonal. C-Channel construction allows the top of the sign to become weight bearing as well as the bottom of the frame may also become weight bearing if required. A solid stop or support may be added to the upright or uprights at a point below the bottom of the sign to allow for a support on the bottom. Ideally, the structure should bear 50% of the weight at the top of the structure and 50% of the weight at the bottom of the structure.

In the event the designer wishes to use the sign single faced, then a vertical or horizontal structural member may be attached to the rear ends of the cross members to create back support bracing thereby enabling the single sided structure to be attached to a building or flat against one or more uprights or existing structures of various configurations.

SUMMARY OF THE INVENTION

The present invention relates to a display device in the form of a sign structure comprising a C-Channel frame construction which allows it to be readily installed on buildings, against support poles or like support means of various sizes and shapes as well as on top of support poles as previously described. In modern day construction of signs, it has been found that constructing these signs from aluminum extrusion rather than conventional steel plates or sheets is more efficient and economical both from a labor and cost of material standpoint. In addition, an aluminum sign structure is subject to less maintenance over the life of the sign.

The present invention combines the obvious advantages of aluminum or similar lightweight material construction while at the same time utilizing relatively standard dimensioned materials.

More particularly, the display device of the present invention comprises one or more frames arranged in spaced relation or a relation to one another. Each frame includes a display face on which letters or like indicia may be movably mounted or integrally applied. These display faces are connected to the outer planar surface or portion of each frame. The inner portion of each frame are arranged in connected, spaced relation to one another by interconnecting means which may be in the form of cross members connected at various points around the periphery edge frame.

The display device may be mounted on a support means which may be in the form of one or more vertical or horizontal oriented standard members extending through the interior of the display device between the single frame and its back braces or between the multiple application frame. As will be described hereinafter, the spacing between the frames and the specific arrangement of the connecting means used to assemble the frame device is dependent upon the size required by the designer of the pole, structure or structures, or as required in architectural style by the designer.

The connecting means comprises at least two bars arranged to substantially traverse the space between the frames and thereby be arranged in interconnecting relation therebetween. The bars may be arranged in spaced, substantially parallel relationship on opposite or different sides of the support means and be welded or mechanically fastened thereto in frame supporting relation to the pole. Of course, the particular orientation and spacing of the connecting bars is dependent upon the configuration of the support means. The cross members are connected to the inner portion of each frame in corresponding relation to one another and serve to have the respective extremities of the connecting cross members or bars attached thereto. The particular point of connection between the connecting bars and the edge frame may be varied dependent upon the configuration and size of the supporting structure(s) or pole allowance structures. This allows the installation of the sign structure on the uprights or members to be generally the same regardless of the size and configuration of the members. As pointed out above this adds greatly to the versatility of such a sign structure since those involved in installing it apply the same installation techniques independent of the configuration of the support means on which the sign structure is mounted. A plurality of the connecting means comprising the connecting bars may be arranged at a plurality of spaced joints along the longitudinal and horizontal sides of the C-Channel frame.

As pointed out above the dimensions of the space between the individual frame is dependent upon the configuration and size of the supporting structures and/or the architectural requirements of the designer. Any display device using this C-Channel construction of the present invention merely adjusts the distance between the connecting bar and the size of the connecting bar and the interconnecting means which connect the frames to one another in order to readily adapt the sign structure to various sized poles and field conditions or to develop a particular style as required by the designer. In order to provide a solid, uniform appearance of the finished device, cover means in the form of aluminum sheets or like material is arranged about the periphery of the sign in order to cover the space between the frames and at least partially enclose and define the interior the display device itself. In that the interior of the device essentially comprises the interior of both frames and the space therebetween, an interior illumination means may be included and/or illumination may be provided on the exterior of the sign structure. Because of the open interior, interior illumination directs illumination to the rear of the display faces thereby allowing the indicia displayed thereon to be readily apparent, even to a casual observer on the exterior of the sign.

DESCRIPTION

FIGS. 1–6 illustrate different types of a C-Channel construction for a peripheral edge frame of a sign.

Figure 1:
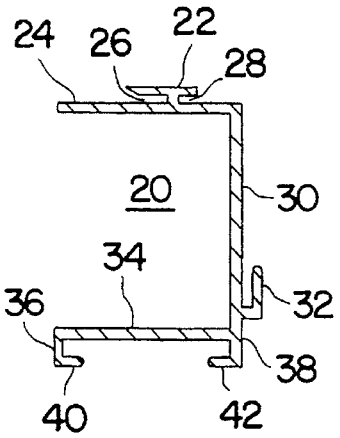
FIGS. 1–6 illustrate a cross sectional view of six different C-Channel peripheral edge frames for a sign.

FIG. 1 illustrates an aluminum extruded C-Channel main body 20 having a T-bar 22 integral with the wall 24 which is configured to form opposing channels 26 and 28 in which the bottom of each channel is aligned with the upper surface of the wall 24, and extend in a direction perpendicular with a front wall 30. The front wall is shown with an integral reversed "L" -shaped arm 32 near a bottom wall 34. The bottom wall is parallel with the upper wall and is provided with end portions 36 and 38 which are provided with a shoulder 40, 42.

Figure 2:
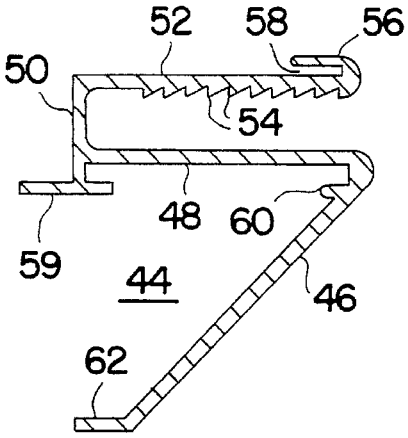

FIG. 2 illustrates an extruded aluminum peripheral edge frame 44 for a sign. The peripheral edge frame has an angularly shaped main body with a front wall 46 at an acute angle with an upper horizontal wall 48. The upper wall forms one leg of a U-shape having an end wall 50 and a second upper wall 52. The inner face of the second upper wall is provided with integral angular teeth or grooves 54 which are angled toward the end wall 50. The open end of the second upper wall is provided with an integral parallel strip 56 that forms a channel 58 across the upper wall. The end wall extends beyond the upper wall 48 into a "T" 59. One leg of the T is spaced parallel with the upper wall 48 and is in alignment with a rib 60 along the front wall and spaced from the upper wall. The bottom end 62 of the front wall 46 extends parallel with the upper wall.

Figure 3:
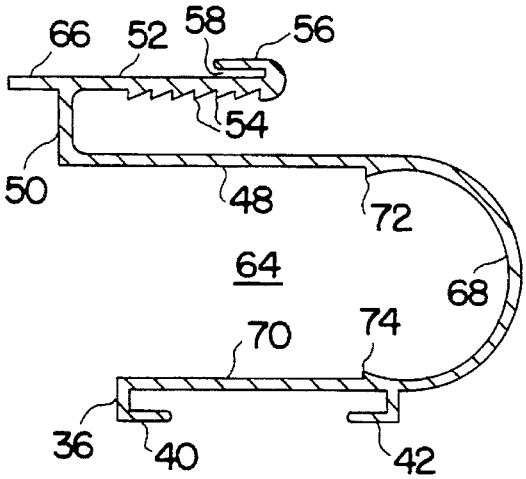

FIG. 3 illustrates an extruded aluminum peripheral edge frame 64. The upper portion of the edge frame 64 is formed with a U-shaped structure such as shown for FIG. 2 and as such is provided with the same reference characters. The second upper wall 52 has a portion 66 that extends beyond the end wall 50. A semi-circular front wall 68 is integral with the open end of the upper wall 48 and a lower wall 70 which is parallel with the upper wall 48. the joint of the front wall with the upper and lower walls from a rib 72, 74 along the length of the frame. The bottom wall is similar to that of the bottom wall 34 of FIG. 1 but has been given a different reference characters.

Figure 4:
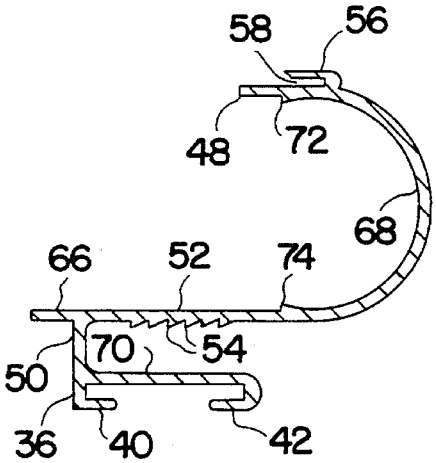

FIG. 4 is substantially a reversal of the upper and lower portions of the peripheral edge frame shown in FIG. 3 and will be given the same reference characters which correspond to the like parts.

Figure 5:
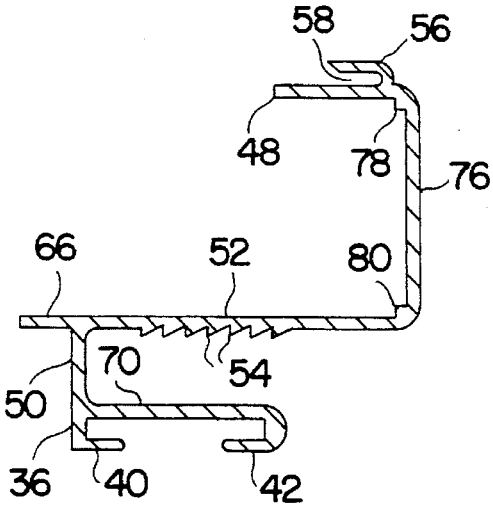

FIG. 5 is a rectangular C-Channel which has a straight front wall 76 instead of a curved wall 68 as shown in FIG. 4. The front wall is supported by corner elements 78 and 80.

Figure 6:
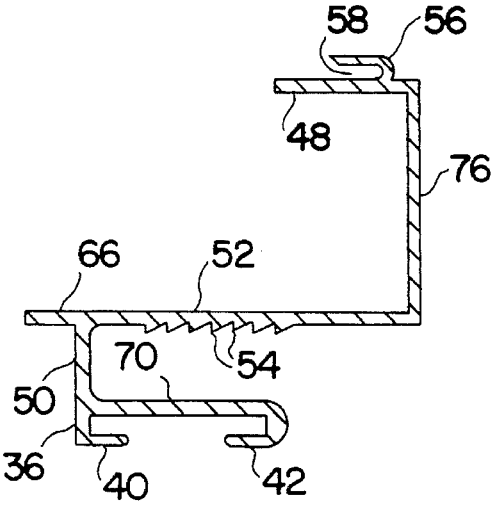

FIG. 6 is similar to the C-Channel shown in FIG. 5 except the front wall does not include the corner support.

Figure 7:
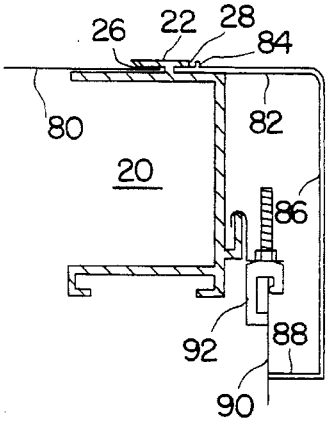
FIGS. 7–15 illustrate each of the different C-Channels shown with a sign face attachment attached thereto.

FIG. 7 illustrates the C-channel peripheral edge frame shown in FIG. 1 as applied in assembly of a sign facing. A filler enclosure sheet on plate 80 that forms the top portion of the sign slides into the channel 26 and a front retainer has one wall 82 that slides into the channel 28 up to a rib 84. The front retainer has a front face 86 that extends down over the front of the peripheral edge frame and is provided with a short bottom wall 88 that extends toward the peripheral edge frame. A sign face 90 is secured at one end by tensioning means 92 which is supported onto the "L"-shaped arm 32 for securing a flexible front face in place. The retainer covers the tensioning means and peripheral edge frame so that the sign has a good look. A similar structure is at the bottom and sides of the sign for securing the front face in place.

Figure 8:
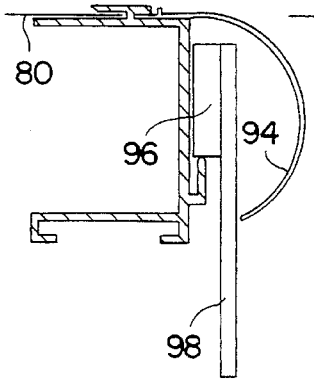

FIG. 8 is similar to FIG. 7 and differs therefrom by a semicircular retainer 94 and a different means 96 for supporting a rigid front face 98 to the peripheral edge frame.

Figure 9:
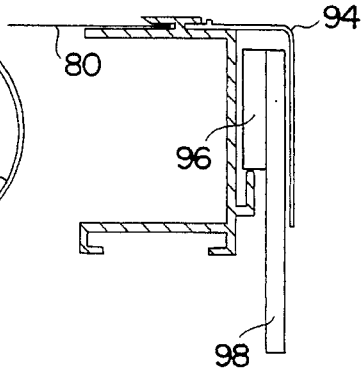

FIG. 9 is similar to FIG. 8 and differs thereover by use of different shaped retainer 94'.

Figure 10:
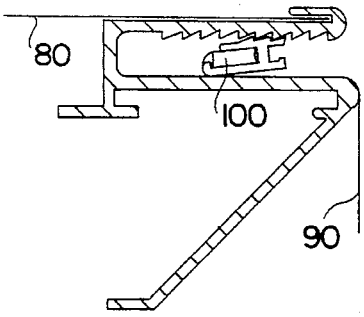

FIG. 10 illustrates the peripheral edge frame shown in FIG. 2 to which a flexible front face 90 is secured thereto by a tensioning means 100. The tensioning means is secured in place by teeth or grooves that mate with the teeth 54 on the peripheral edge frame.

Figure 11:
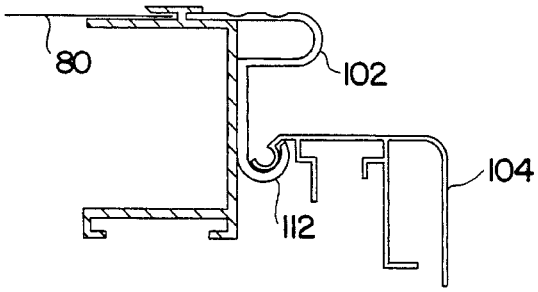

FIG. 11 sets forth a peripheral edge frame similar to that shown in FIG. 1 which does not have the L-shaped arm 32. In the edge frame of FIG. 11 a special extruded frame attachment 102 is secured over the front face by use of the channel 28 and includes a semi-circular retainer 112 on the special attachment. A rigid front face 98, not shown, of the sign is secured to the retainer part 104 within the spacing 106 such as shown in FIGS. 8 and 9.

Figure 12:
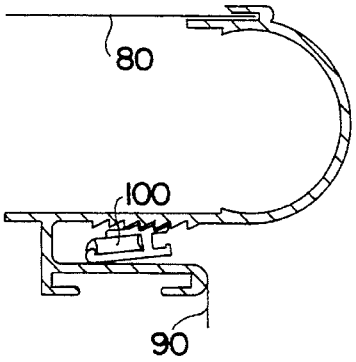

FIG. 12 sets forth a peripheral edge frame such as shown in FIG. 4. A flexible front facing 90 is secured to the edge frame in the same manner as set forth in FIG. 10.

Figure 13:
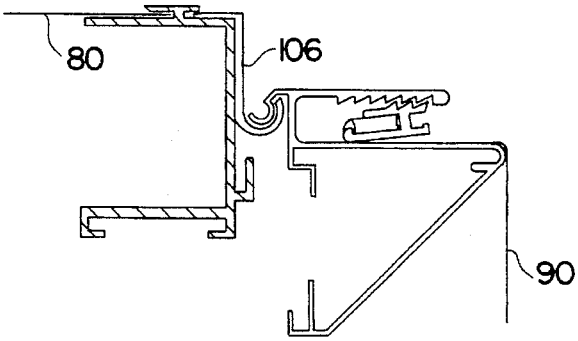

FIG. 13 sets forth a peripheral edge frame as shown in FIGS. 1 and 7. Instead of the retainer and tensioning device as shown in FIG. 7 an extruded straight clamp 106 with a semi-circular retainer 112 is provided upon which an edge frame 44 such as shown in FIGS. 2 and 10 having an additional supporting end 103 are supported. A tensioning means 100 is used to tension the flexible front face 90.

Figure 14:
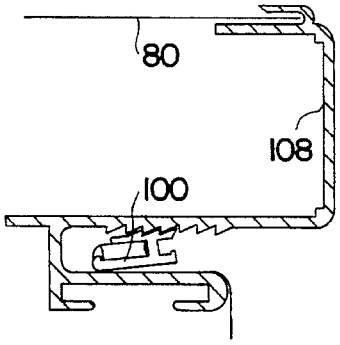

FIG. 14 sets forth a peripheral edge frame similar to that in FIG. 12 except that the front edge frame 108 is straight. A flexible front face is shown secured to the edge frame by use of a tensioning means 100.

Figure 15:
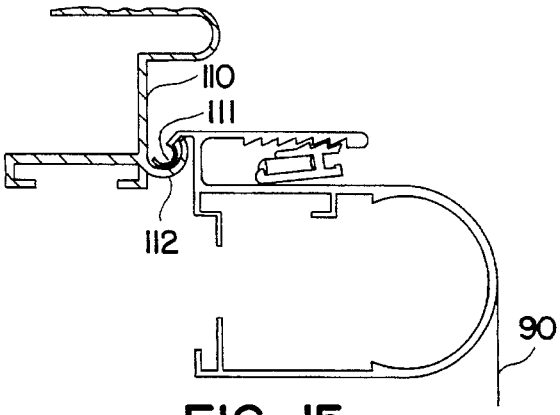

FIG. 15 illustrates a cross-sectional view of a peripheral edge frame in which the edge frame front face 110 is similar to a combination of the edge frame and extruded sign face attachment 102 shown in FIG. 11 having the semi-circular receiver 104. A peripheral edge frame such as shown in FIG. 3 modified to include a semi-circular hook 111 that fits into the semi-circular retainer 112 of the front face edge frame 110 is provided to secure a flexible sign front face 90 into place.

FIGS. 1–15 illustrate different types of C-Channel peripheral edge frames with different combinations by which a sign front face is secured into place on a finished sign. Such peripheral edge frames may be assembled for single sided or double sided signs. The edge frames shown are for the upper peripheral edge frame. Similar edge frames may be used for the bottom and both sides of a sign.

A peripheral edge assembly or edge frame typically incorporates extended legs or appendages to form a "C" channel. The outer or exposed portion of the "C" channel may be any geometric shape or any combination of geometric shapes including but not limited to triangle, hexagon, octagon, oval, ellipse, circle, semi-circle, etc. or any combination of the shapes listed;

The peripheral edge assemblies or edge frames are connected together with cross members or connector bars which fit into the extended legs of the "C" channels of each peripheral edge or edge frame. Cross members or connector bars may be any geometric shape and formed by any material. Cross members or spacer bars may be held in place by one or more of the following methods including but not limited to bolting, welding, screwing or riveting, braiding or crimping, gluing, caulking, glazing etc. or any combination of the above;

Double faced structures require two (2) "C" channel peripheral edge assemblies or edge "frames". Each "edge frame assembly or edge frame" may be fabricated in any geometric shape or any combination of shapes including but not limited to hexagon, rectangular, square, circle, ellipse, octagon, semi-circle etc. When the edge "frame(s)" are assembled and connected with cross members or connector bars, a sign base frame structure or sign embodiment structure is formed or creates the sign "base frame".

Sign base frames would typically be enclosed or filled in around the outward sides or ends with some type of filler or closure material placed over the cross members or connector bars and secured to the "C" channel edge profiles. The filler or closure material may include but not be limited to sheet metal, aluminum sheet, extruded aluminum, plastic, sheet plastic, eggcrating, wood mesh or flexible substrate such as fiberglass reinforced P.V.C. The filler may be retained by specific grooves in the edge frame. The closure or filler material may also be fastened with any means such as welding etc. as set forth above.

The base frame structures or embodiment fitted with filler or closure material may then be used as a receiver for attachment of sign faces. Sign faces include but are not limited to aluminum, sheet metal, sheet aluminum, extruded aluminum, rigid plastic, wood, glass or a flexible facing such as fiberglass reinforced P.V.C. or any combination of materials listed herein;

Attachment of sign faces may be by utilization of any fastener such as shown in FIGS. 1–15 as an alternate, faces may fit into a grooved or specialized receiver or system of interlocking legs or appendages designed to structure attached sign faces or sign facing frames to a sign base frame;

Single face base frame units may be fabricated with one "C" channel peripheral edge assembly or edge frame assembly whereas, the remainder of the support structure of the sign base frame assembly may be fabricated with materials typically used for cross members or spacer bars as set forth above. Structural support members may be fabricated and fitted from top to bottom and/or side to side or end to end. Single sided base frame structures typically are covered on the top and bottom, ends and back with a choice of closure materials including but not limited to material such as sheet metal, aluminum sheet, extruded aluminum, plastic, sheet plastic, eggcrating, wood, mesh or flexible substrate such as fiberglass reinforced P.V.C.;

Such a sign base frame assembly or embodiment may include exterior illumination added externally by any light source directed to the exterior whereas, interior illumination could be achieved by adding an interior light source within the structure. Light sources may include but not be limited to neon, fluorescent, mercury vapor, metal halide halogen incandescent or any combination or such as a sign base frame assembly or embodiment may be non-illuminated.

Figure 16:
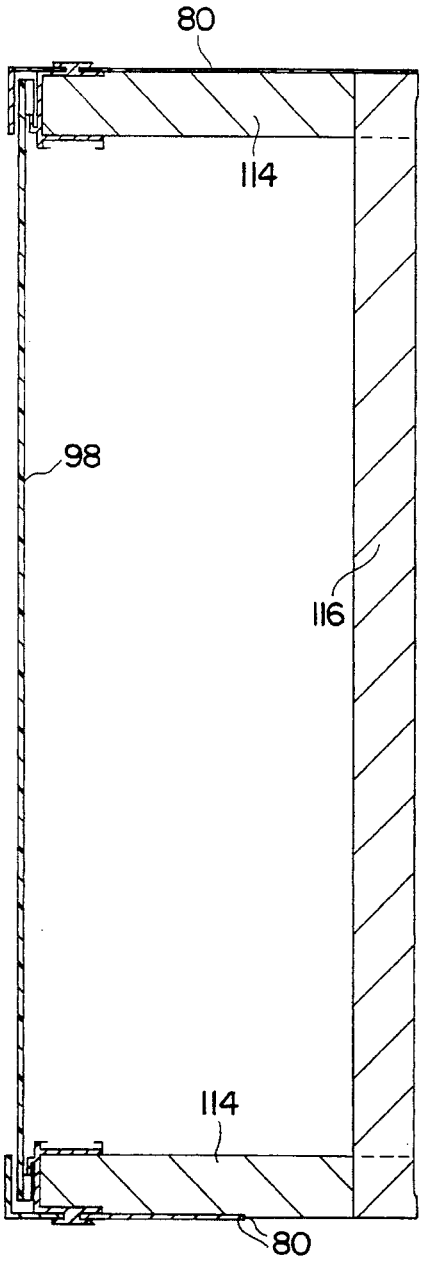
FIG. 16 illustrates an end view of a sign frame assembly with an installed single face.

FIG. 16 illustrates an end view of a single face sign. The single face sign is made by use of a peripheral edge frame such as shown in FIGS. 1 and 9. Cross members 114 are secured at one end by welding or any other manner to back supports 116. The peripheral edge frames 20 are secured to the cross members in any suitable manner. A filler enclosure sheet or plate 80 is secured across the top, bottom and sides of the sign. One end of the filler sheet slides into the slit 26 in the peripheral edge frame. The sign is shown with a rigid front face 98 which is supported by the reversed "L" element 32 and the retainer 100 as shown in FIG. 9 is secured in place to the upper and lower peripheral edge frames. Illumination not shown may be secured within the sign before the sign front face 98 is fixed in place.

Figure 17:
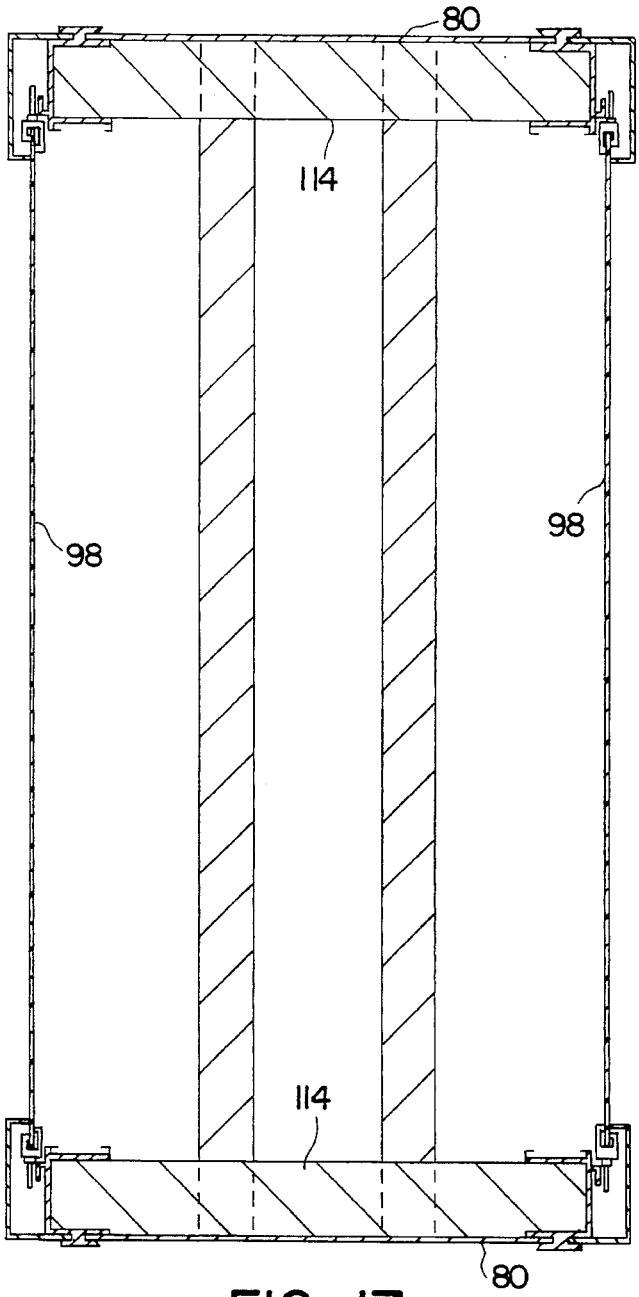
FIG. 17 illustrates an end view of a single frame with an installed double face.

FIG. 17 illustrates a double faced sign. As shown, the sign includes interior supports 116 with upper and lower cross members 114 which are secured to the interior supports by any suitable means. The peripheral edge frames are the same as shown in FIG. 16 and is provided with an upper and lower filer enclosure sheet or plate 80. In this sign a flexible front face 90 is secured in place by a tensioning means 92 and retainer 86 such as shown in FIG. 7.

Figure 18:
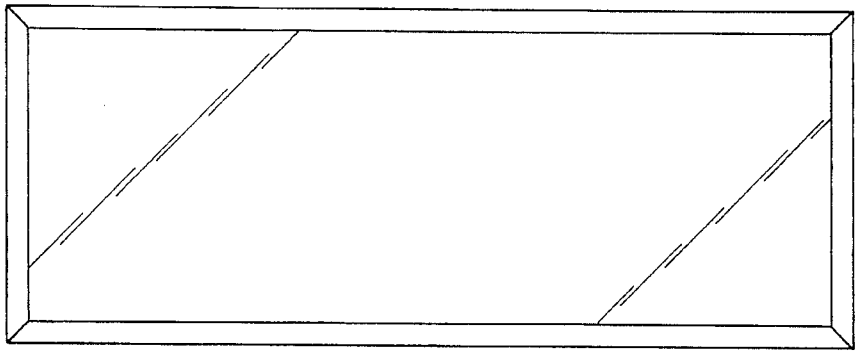
FIG. 18 illustrates a front view with a face installed.

FIG. 18 illustrates a front view of a completed sign showing the retainer and front face of the sign. Such a sign may be formed by use of any of the different peripheral edge frames, supports etc. as set forth above.

The corners of the peripheral edge frame may be joined by any well known means such as mitered corners of any desired shape, rounded fabricated corners, Kerf cut corners and or 90 degree tubular means with a connector that joins the 90 degree tubular means to the enclosure of the peripheral edge frames.

It should be obvious to one skilled in the art that the back supports and cross members should be assembled together by welding, etc. Then the peripheral edge frames may be secured to the cross member. The peripheral edge frames may be selected from any of the above described peripheral edge frame or any other similar combination of frames. The corners may be mitered or by use of any fabricated or prefabricated parts if desired. The rigid or flexible front face can be assembled by use of a retainer tensioning means etc. after any desired illuminating means has been installed, if desired.

It is readily seen that a rigid face or a flexible face may be used for a sign depending upon the peripheral edge frame and/or tensioning means used.

The foregoing relates to a preferred exemplary embodiment of the invention, it being understood that other variants and embodiments thereof are possible within the spirit and scope of the invention, the latter being defined by the appended claims.

What is claimed:

1. A peripheral edge frame for a sign which comprises an extruded elongated linear single piece body including a linear first wall and a linear second wall substantially parallel with said first wall, a closed end linear back wall (50) between said first and second walls and directly connected to each said first and second walls, said first and second walls directed in a same direction from said closed end wall and forming a linear opening adapted to receive one extremity of a sign face, said first wall including integral angular teeth in which said teeth are angled toward said closed end back wall, a front wall (46, 68, 76, 108) integral with one end of one of said first and second substantially parallel walls which are directed in the same direction from said closed end back wall, said front wall having a first end defining a third wall portion, said third wall portion being substantially parallel with at least one of said linear first and second walls and defining an open cavity formed between one of said linear first and second walls and said third wall and confined by said front wall, and an unobstructed opening of said open cavity opposite from said front wall is adapted to receive a structural element of a sign frame directed toward said front wall.

2. A peripheral edge frame for a sign as set forth claim 1, which includes means defining a slot (58) formed an integral part of said peripheral edge frame in an outermost part thereof to which a filler enclosure sheet can be secured.

3. A peripheral edge frame for a sign as set forth in claim 2, which includes means for supporting a sign face between said first and second walls.

4. A peripheral edge frame for a sign as set forth in claim 3, in which said means for securing a sign face includes tensioning means (100) which is secured in place by protruding teeth that engage said integral angular teeth (54) on said first wall (52).

5. A peripheral edge frame for a sign as set forth in claim 1, in which said front wall forms an angle with said second wall, and said linear opening is adapted to receive a tensioning means for securing a sign face in place whereby said sign face applies a locking force on said tensioning means to prevent slippage of said tensioning means.

6. A peripheral edge frame for a sign as set forth in claim 1, in which said front wall (68) is semi-circular in form.

7. A peripheral edge frame for a sign as set forth in claim 6, in which said front wall includes an integral parallel strip (56) that forms a channel (58).

8. A peripheral edge frame for a sign as set forth in claim 6, in which said second wall includes spaced integral shoulders (40,42; 59,60).

9. A peripheral edge frame for a sign as set forth in claim 1, in which said front wall has a straight portion perpendicular with said first wall.

10. A peripheral edge frame for a sign as set forth in claim 1, which includes corner supports at opposite ends of said front wall.

11. A peripheral edge frame for a sign which comprises an extruded elongated linear single piece body including a linear first wall and a linear second wall substantially parallel with said first wall, a closed end linear back wall (50) directly connected to a first end of each of said first and second walls with said second wall spaced from said first wall and a second end of each of said first and second walls extending in a same direction from said closed end linear back wall, said first and second walls forming a linear opening adapted to receive one extremity of a sign face, said first wall including integral angular teeth in which said teeth are angled toward said closed end linear back wall, a front wall (46, 68, 76, 108) integral with said second end of one of said first and second substantially parallel walls, said front wall having a first end defining a third wall portion, said third wall portion being substantially parallel with at least one of said linear first and second walls and defining an open cavity formed between one of said linear first and second walls and said third wall and confined by said front wall, and an unobstructed opening of said cavity opposite from said front wall is adapted to receive a structural element of a sign frame directed toward said front wall.

12. A peripheral edge frame for a sign as set forth in claim 11, which includes means defining a slot (58) formed by an integral part of said peripheral edge frame in an outermost part thereof to which a filler enclosure sheet can be secured.

13. A peripheral edge frame for a sign as set forth in claim 11, in which said front wall forms an angle with said second wall, and said linear opening is adapted to receive a tensioning means for securing a sign face in place whereby said sign face applies a locking force on said tensioning means to prevent slippage of said tensioning means.

14. A peripheral edge frame for a sign as set forth in claim 11, in which said front wall (68) is semi-circular in form.

15. A peripheral edge frame for a sign as set forth in claim 14, in which said front wall includes an integral parallel strip (56) that forms a channel (58).

16. A peripheral edge frame for a sign as set forth in claim 14, in which said second wall includes spaced integral shoulders (40,42; 59,60).

17. A peripheral edge frame for a sign as set forth in claim 11, in which said front wall has a straight portion perpendicular with said first wall.

18. A peripheral edge frame for a sign as set forth in claim 11, which includes corner supports at opposite ends of said front wall.

19. A peripheral edge frame for a sign as set forth in claim 11, which includes means for supporting a sign face between said first and second walls.

20. A peripheral edge frame for a sign as set forth in claim 19, in which said means for securing a sign face includes tensioning means (100) which is secured in place by protruding teeth that engage said integral angular teeth (54) on said first wall (52).

* * * * *